United States Patent [19]

Walter

[11] 4,043,289

[45] Aug. 23, 1977

[54] MARINE KEEL COOLER

[75] Inventor: Gustave Walter, Jersey City, N.J.

[73] Assignee: The Walter Machine Company, Inc., Jersey City, N.J.

[21] Appl. No.: 606,784

[22] Filed: Aug. 22, 1975

[51] Int. Cl.[2] ..... B61D 27/00

[52] U.S. Cl. ..... 115/75; 165/44

[58] Field of Search ..... 115/.5 HC; 165/44, 143, 165/174, 179, 145; 138/115, 116

[56] References Cited

U.S. PATENT DOCUMENTS

| | | | |
|---|---|---|---|
| 1,290,112 | 1/1919 | Deckert | 165/174 |
| 2,257,721 | 9/1941 | Dufault | 165/145 |
| 2,258,526 | 10/1941 | Walter | 115/.5 HC |
| 2,326,716 | 8/1943 | Wood | 138/116 |
| 2,356,844 | 8/1944 | Higgins | 165/44 |
| 2,415,154 | 2/1947 | Walter | 115/.5 HC |
| 2,466,525 | 4/1949 | Wilson | 165/44 |
| 2,550,725 | 5/1951 | Schultz | 138/116 |
| 3,177,936 | 4/1965 | Walter | 165/44 |
| 3,841,396 | 10/1974 | Knaebel | 165/44 |

*Primary Examiner*—Trygve M. Blix
*Assistant Examiner*—Charles E. Frankfort
*Attorney, Agent, or Firm*—Edward F. Connors

[57] ABSTRACT

The single tube or single tube of a three, five or the like uneven number of tubes extending between a header unit attached to the underside of a boat hull in communication with the water circulating pump of the inboard engine and a return fitting attached to the underside of the hull is centrally divided into side-by-side separate compartments of equal area and volume by a longitudinally extending flat divider plate so that the uneven number of tubes is converted into an even flow number whereby an accurate volume flow can be achieved between the header and the return fitting in terms of the volume capacity of the water circulating pump.

3 Claims, 10 Drawing Figures

FIG. 7
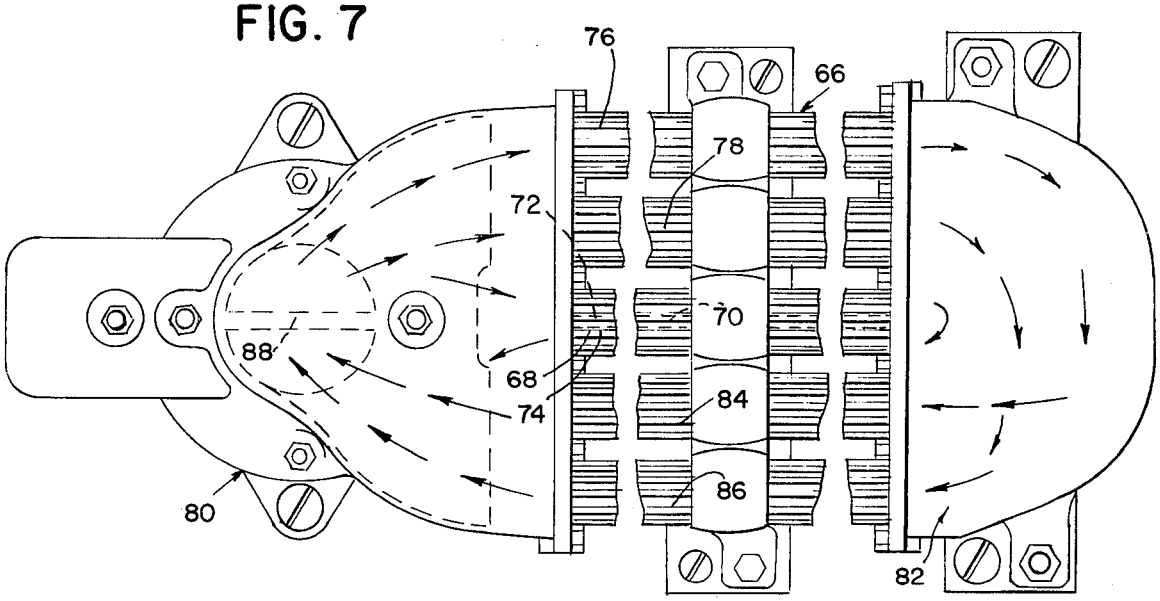
FIG. 8
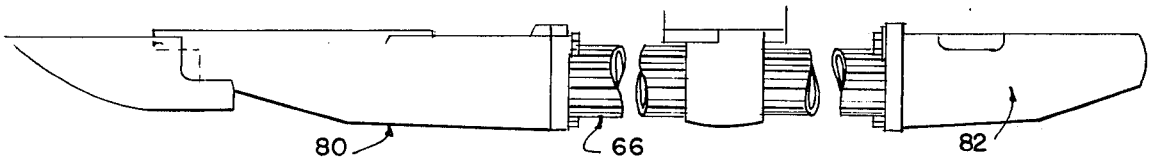
FIG. 9
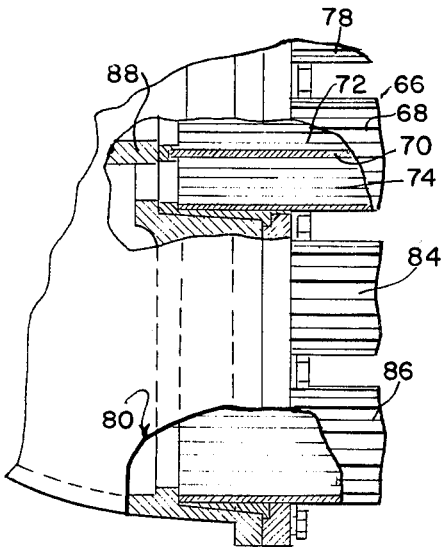
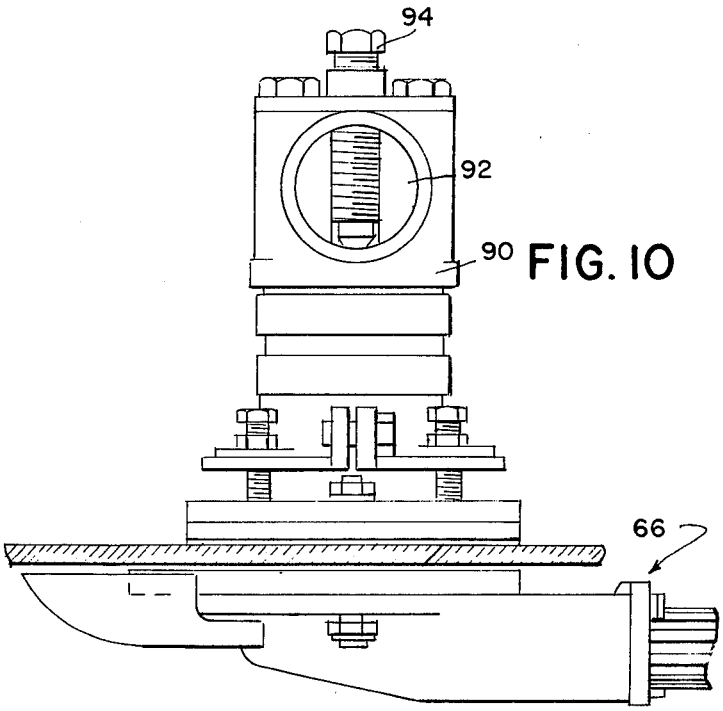
FIG. 10

MARINE KEEL COOLER

BACKGROUND OF THE INVENTION

1. Field of the Invention

The present invention generally appertains to new and novel improvements in heat exchangers and more particularly relates to a novel and improved heat exchanger especially suited for use as a marine keel cooler.

2. State of the Prior Art

The present invention is an improvement on marine heat exchangers for use as keel coolers and attendant systems as disclosed in my prior U.S. Pat. Nos. 2,258,526 and 3,177,936 and also as disclosed in U.S. Pat. No. 3,561,524.

Generally, such keel coolers include a header which is vertically partitioned into two separate chambers and which is fixed on the underside of the hull and is connected through the hull to the water or coolant circulating pump of the inboard marine engine. The chambers of the header are connected by longitudinally extending heat exchange tubes to a return fitting which is mounted on the underside of the hull and is longitudinally spaced from the header. The tubes are generally finned or fluted cooling tubes with the purpose of the fins being to achieve a decrease in the necessary lengths of the cooling tubes while at the same time increasing the heat exchange capacity of the tubes.

In operation, the heated water for the inboard marine engine or other equipment being cooled, such as accessory equipment, is pumped through one chamber of the header so as to flow through the tubes where it is cooled before it is recirculated from the return fitting through the tubes back to the other chamber of the header and the marine engine or other equipment being cooled. In this way, a closed cooling system is realized whereby the engine is completely closed off from the raw water in which the boat travels and whereby such raw, sandy and muddy water cannot grind up the circulating pump or build up in the engine water jackets. Also with the partitioned header only one opening need be made in the boat hull with the heated water passing through one chamber from engine to cooling tubes and returning to the engine after being cooled through the other chamber.

One of the difficulties attendant with such conventional marine keel coolers, as those disclosed in my afore-mentioned patents, resides in the fact that the desirability is to increase the heat exchange capacity of the tubing and attendant keel cooling system while decreasing the structural capacity and mounted extent thereof on the hull.

In my prior U.S. Pat. No. 3,177,936 means was disclosed whereby a new form of tubing could be used so as to shorten the length and decrease the diameter of the tubing while still developing greater heat exchange capacity. This was most efficient having regard to the longitudinal extent of the hull of a boat. However, the problem remained of the width or transverse capacity of the hull having in mind the specified coolant volume capacity of a given water circulating pump for a marine engine or accessory equipment mounted within the hull.

For example, a marine engine equipped with a 1¼ inch water circulating pump requires a keel cooler of one and a quarter inch volume capacity and a two tube cooler with one tube carrying the circulating heated water from the header to the return fitting and the other tube bringing the cooled water from the return fitting back to the header. The tubes are of the axially fluted or finned nature, as disclosed in my U.S. Pat. No. 3,177,936, and have an outside diameter of 1½ inches with an inside square area of 1.223 and carry a liquid volume equal to a 1¼ inch pipe.

Continuing with the foregoing example, the next larger commercial pump available is a size 1½ inch which requires a 1½ inch tube flow or an area of 1.76 square inch to handle the volume so that a two tube cooling system with a single tube flow from header to return fitting and from return fitting back to header is inadequate. If an attempt to solve the problem is made by using a dual flow four tube cooling system whereby two tubes carry the flow from the header to the return fitting and two other tubes carry the return flow from the return fitting to the header then this will be a system that can handle a flow volume of 2.43 square inches which results in an oversized cooling system that has a reduced flow. And such oversized cooling system and attendant reduced flow results in higher costs and less heat exchange.

SUMMARY OF THE INVENTION

In accordance with the present invention, an uneven number of cooling or heat exchanger tubes are utilized to connect the header with the return fitting so as to avoid the disadvantage of employing a greater number of even number of tubes in the cooling system so as to produce an oversize cooling system. With the present invention, a single tube, three tube, five tube or any given number of uneven tubes can be arranged longitudinally between the header and the return fitting and thereby minimize the transverse space factor beneath the hull of the boat. As disclosed in my prior U.S. Pat. No. 3,177,936, the tubes are fluted in such a way that they are provided with longitudinally running circumferentially spaced internal projections separated by internal grooves that also run parallel with the long axis of the tube. The internal grooves and the internal projections are arranged in diametric pairs which pairs are angularly spaced around the circumference of the tube. Thus, a fluted tube wall is realized which effects a decrease in the length and decrease in the diameter of the tube while developing greater heat exchange capacity.

In order to utilize an odd number of tubes, the center tube, in the instance of three, five or the like number of tubes or, the single tube, in the instance of one tube alone being used, is divided into two separate and completely sealed off longitudinal compartments by a suitable vertical divider or partition plate which extends longitudinally through the entire length of the middle or central tube or the single tube alone and which has one end extending into the header and attached to and supported by the vertical partition plate in the header, which is disclosed in my prior U.S. Pat. No. 3,177,936 and which divides the header into two chambers. The opposing side edges, that is, the upper and lower edges of the vertically disposed divider are wedged tightly into the diametrically opposing grooves and fitted between the internal pair of projections defining the top groove and the pair of projections forming the bottom groove.

By virtue of the partition in the center or single tube, such tube is divided into two separate and completely sealed off sections of an equal size and area and with the same volume flow capacity.

Having regard to a three tube cooling system, the main header, of course, is divided into the two separate vertical chambers and the center cooling tube is provided with the longitudinally extending divider plate which has its opposing longitudinal upper and lower side edges fitted snugly within diametrically opposing grooves of the fluted center tube and snugly received within the internally extending radial projections that define such grooves. Thus, the center tube is sealingly divided into the two equally dimensioned sections. This effectuates a change in the three tube cooling system of a size 1½ inch flow into four tubes which results in a 1.8 square inch area flow or a flow equal to the 1½ inch pump flow. Therefore, with a commercial pump of a size 1½ inch which requires a 1½ inch pipe flow or an area 1.76 square inch to handle the volume, when a two tube cooling system flow is inadequate and a four tube cooling system would be impractical and oversize, the three tube cooling system of the present invention with the center tube divided into the two compartments will equal the 1½ inch pump flow.

The divider or partition within the center tube has one end fitted tightly and sealingly against the partition in the header and its opposing end fitted within a notch in an elastic bushing within the casting of the return fitting.

In the instance of a larger size pump of 2 inches which requires a 2 inch pipe to carry its volume of circulating water which is 3.14 square inches and is equal to a five tube cooling system, namely, 2½ inch tubes with a volume of 3.07 square inches or almost exactly to a 2 inch volume flow, the division of the center tube changes the uneven number of cooling tubes into an even number for accurate flow volume whereby effective and efficient heat exchange can be realized with an economical construction.

Another important object of the present invention is to provide means whereby an uneven number of fluted connecting cooling or heat exchange tubes between a header and a return fitting can be changed into an even number by a suitable divider in the middle or center tube which results in a flow that will be approximately equal to the volume capacity of the water circulating pump.

A further object of the present invention is to provide a very simple but highly economical cooling system which can be installed in a minimum of lateral hull space and which can operate most efficiently to produce an accurate volume flow within the tubes from the header to the return fitting for efficient heat exchange.

BRIEF DESCRIPTION OF THE DRAWINGS

FIG. 7 is a bottom plan view of a further modified form of cooling system wherein five tubes are connected between the header and the return fitting.

FIG. 8 is a side elevational view of the system of FIG. 7.

FIG. 9 is a fragmentary bottom plan view, primarily in section, of the header end of the cooling system of FIG. 7.

FIG. 10 is a detailed side elevational view of the header end of the cooling system of FIG. 7.

DESCRIPTION OF THE PREFERRED EMBODIMENTS

Figure 1:
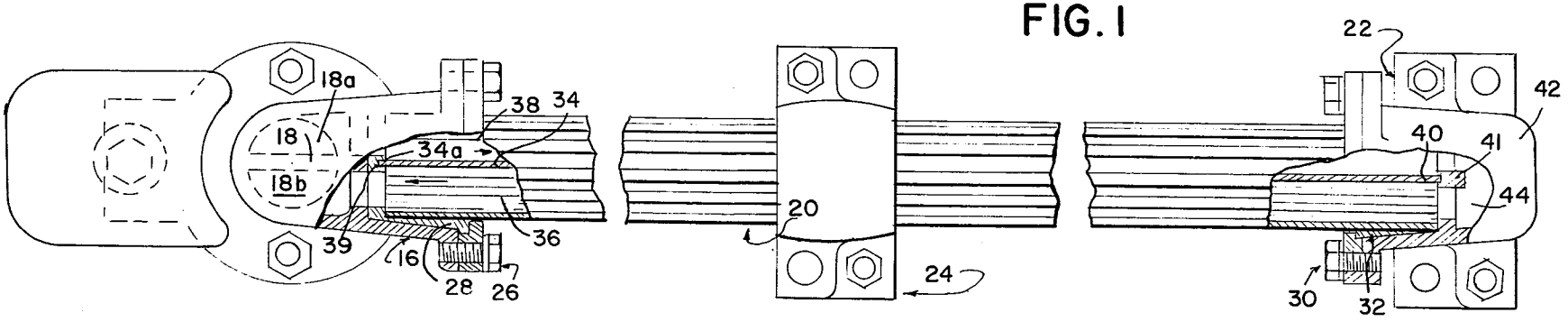
FIG. 1 is a bottom plan view of a one tube keel cooler system in accordance with the present invention.
Figure 2:
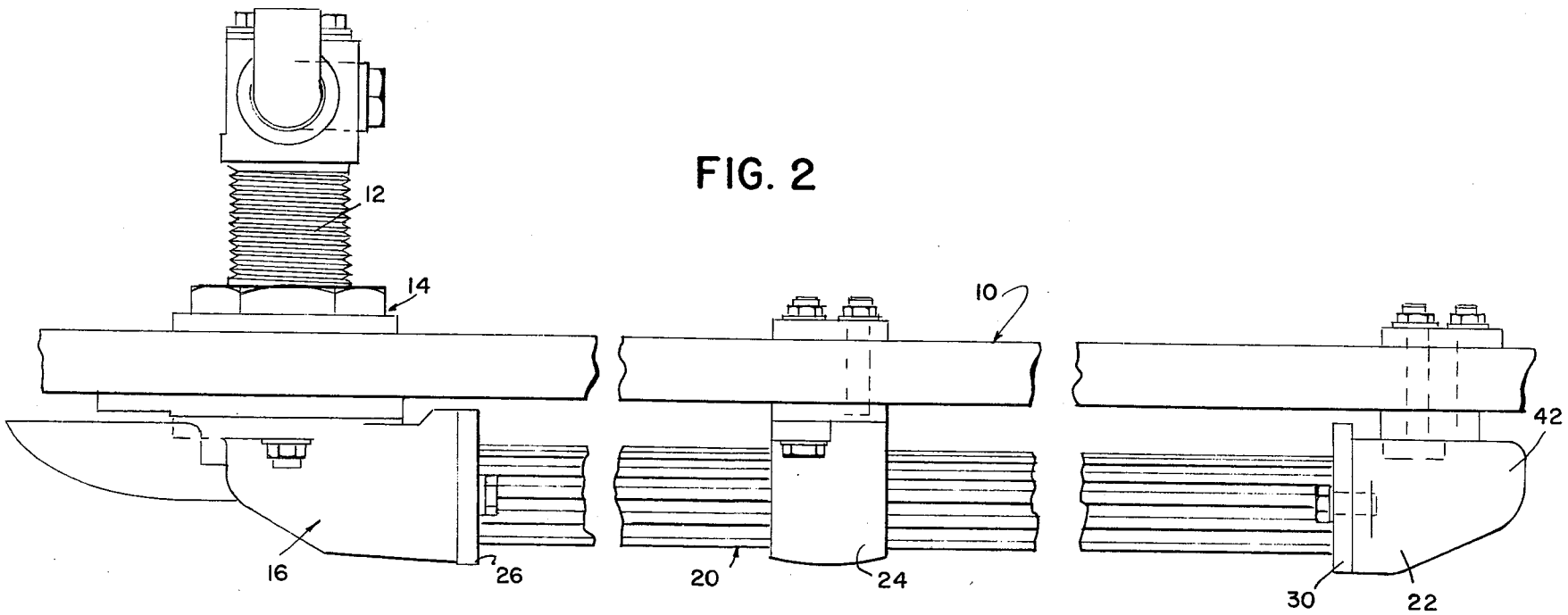
FIG. 2 is a side elevational view of the arrangement of FIG. 1.

Referring now more particularly to the accompanying drawings and initially to FIGS. 1 and 2, the reference numeral 10 generally designates the hull of a boat, which is powered by an inboard marine engine (not shown) but which is conventional and which has an engine water jacket and a water circulating pump for cooling purposes.

A stem or standpipe 12 is positioned through a hole in the hull 10 adjacent one end thereof and is externally threaded so that means 14 secures it in place within the opening in the hull. The upper end of the stem is adapted to be connected to the circulating pump of the engine.

The lower end of the stem is connected to a header 16, which constitutes the header of the cooling system and which is internally divided by a vertical partition 18 into chamber or sections **18*a* and 18*b*. The chamber 18*a* is adapted to receive hot water from the engine water jacket while the section 18*b*** is adapted to recirculate cool water back to the engine.

Figure 6:
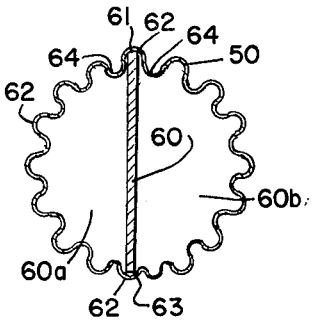
FIG. 6 is a transverse sectional view taken substantially on lines 6—6 of FIG. 3 and illustrating in detail the central divider partition disposed within the center or middle tube of the cooling system.

A longitudinally finned or fluted tube 20 connects the header 16 with a longitudinally spaced return fitting 22 that is suitably attached to the underside of the hull. The tube 20 is formed so that its wall has a wave-like affect in that the wall is provided with a series of radially internally extending projections separated by internal grooves with the projections and grooves running parallel with the longitudinal axis of the tube, as best shown in FIG. 6 and as will be more particularly described.

The cooling system of FIGS. 1 and 2 embodies the provision of a single tube 20 connecting the header 16 and the return fitting 22. Intermediate the header and return fitting, the tube is supported by a clamp means 24 which is attached to the hull 10. The single tube 20 is internally constructed, in accordance with the present invention, so that it can suffice in and of itself to carry the circulating water from the header 16 to the return fitting 22 and then from the return fitting back to the header whereby the water will be cooled as it comes in a hot condition from the engine and is returned in a cool condition to the engine.

The fluted tube 20 is fixed by a mounting plate means 26 and associated sealing means 28 within a suitable opening in the header while the opposite end of the tube is secured within the return fitting by mounting plate means 30 with an associated sealing means 32.

In accordance with the present invention, the single fluted wall tube 20 is provided with a longitudinally extending, centrally disposed elongated partition or divider 34 which is arranged vertically within the tube at the exact center or midpoint thereof so as to divide the tube into two side by side but entirely sealed off and separate compartments 36 and 38 which are of exactly equal dimensions and area. In this fashion, the single tube 20 is divided into two sections so as to constitute two tubes within its internal area. The longitudinal divider or partition 34 has one end 34a tightly fitted within a suitable notch formed in the vertical outer edge portion 39 of the partition 18 within the header 16. The opposite end portion 40 of the divider or partition abuts or is engaged within a suitable divider bar 41 formed in the return fitting 22 and spaced from the rear wall 42 thereof so as to define therewith a U-shaped passage 44 in the return fitting.

As can be appreciated, the hot water or other coolant from the engine water jacket or other accessory within the boat hull is forced by the circulating pump associated with the engine or accessory within the hull into the compartment 18a of the header from whence it enters the tube compartment or section 38 so as to flow lengthwise of the tube 20 on one side of the vertical longitudinally extending divider or partition 34. The flowing liquid enters the return fitting 22 and its flow path is reversed so that it flows back through the compartment 36 in the tube 20 and into the chamber 18b of the stem or standpipe of the header 16 from whence it returns to the engine water jacket.

In the embodiment of FIGS. 3–6, the keel cooler 46 is of the three tube type with each of the tubes 48, 50 and 52 being identical in construction to the tube 20 of FIGS. 1–2. The header 54 is adapted to be connected to a stem or standpipe and is formed with the vertical partition 56 so as to divide it into separate chambers 56a and 56b as in the instance of the chambers 18a and 18b of the embodiments of FIGS. 1 and 2. The return fitting 58 is constructed so as to receive the ends of the tubes which also have their opposing ends sealing socketed within the header in the same manner as the mounting of the tube 20 in the header 16 and return fitting 22 of FIGS. 1 and 2.

In the instance of the embodiment of FIGS. 3–6, it is to be understood that the boat is equipped with a commercial pump of the regular size one and a half inch which knowingly requires a one and a half inch pipe flow or an area of 1.76 square inch to handle the volume of the pump. It is well known that a conventional two tube cooling system with a single outlet flow in one tube and a single return flow in the other tube would be inadequate. However, the use of a dual flow or four tube cooling system which is intended to handle a flow volume of 2.43 square inches would mean that an oversized cooling system is provided. This would result in a reduced flow and, of course, attendant with this would be higher costs and less heat exchange.

Consequently, in accordance with the present invention the three tubes 48, 50 and 52 are used but the center tube 50 is divided by the longitudinal divider or partition 60, identical to the divider or partition 34, into a two vertical side by side compartments 60a and 60b. The compartment 60a functions with the tube 48 in carrying the hot water or coolant from the header 54 to the return fitting 58 while the compartment 60b cooperates and works with the outer tube 52 in returning the cooled water from the return fitting to the header.

As is the case in the instance of the divider 34 for the tube 20, the divider or partition 60 for the tube 50 is sealing and snugly fitted within the tube, as shown in FIG. 6. As can be appreciated from a consideration of FIG. 6, the opposing longitudinal side edges 61 and 63 of the flat divider or partition plate 60 are fitted snugly within the diametrically opposing grooves 62 formed in the wall of the tube by virtue of the radially internally extending circumferentially spaced projections 64. Of course, the wave like affect of the fluted tube is not peculiar to the present invention but is disclosed in my prior U.S. Pat. No. 3,177,936. And, of course, all of the tubes are of such construction. However, the provision of the grooves makes it easier to sealingly mount the divider or partition within the single tube 20 of FIG. 1 or the middle or center tube 50 of the odd three number system of FIGS. 3–6.

As in the instance of the partition or plate 34 in FIGS. 1 and 2, the divider or partition plate 60 of FIGS. 3–6 has its one end fitted within the outer vertical edge of the partition 56 in the header and its opposing end mounted within the return fitting in the manner shown in FIG. 1.

Figure 3:
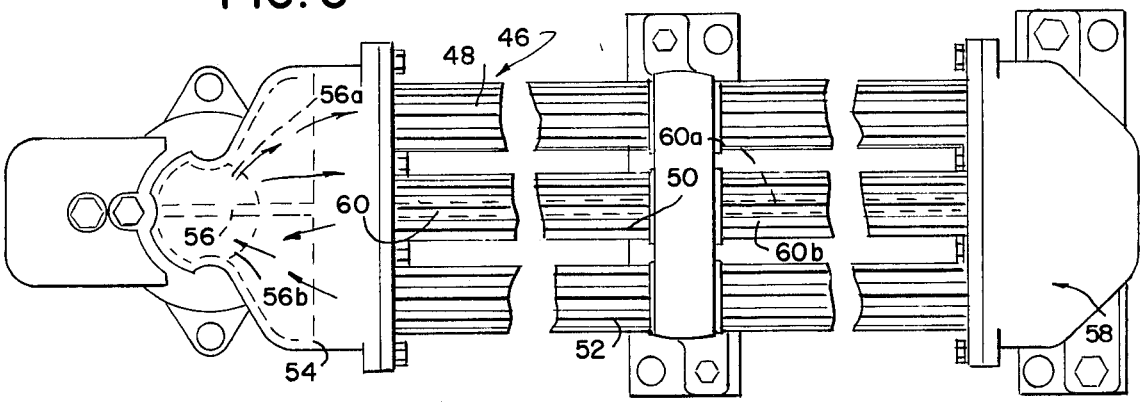
FIG. 3 is a bottom plan view of a modified marine keel cooler system employing three fluted tubes connecting the header and the return fitting.
Figure 4:
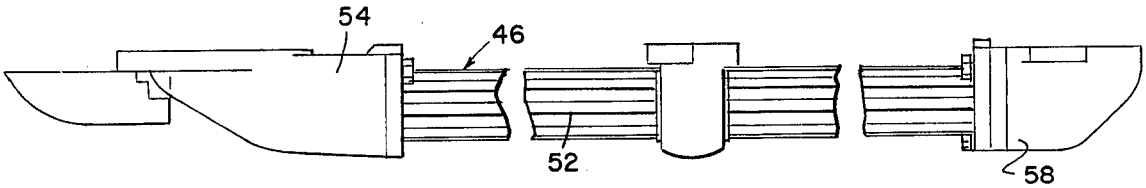
FIG. 4 is a side elevational view of the system of FIG. 3.
Figure 5:
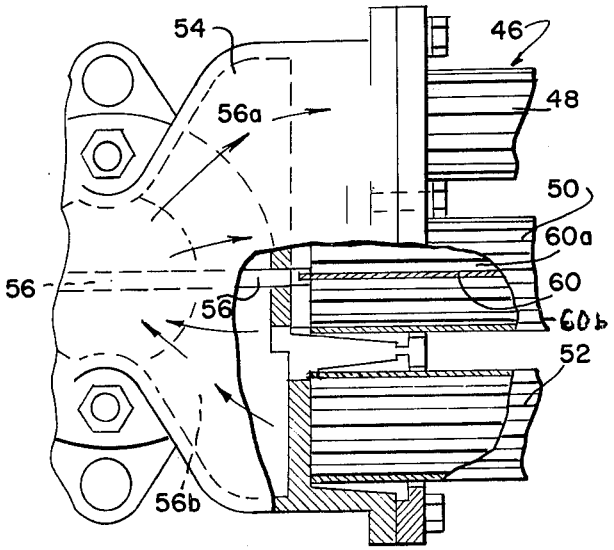
FIG. 5 is en enlarged bottom plan view, partly in section, of the header end of the cooling system of FIGS. 3 and 4.

In the instance of the embodiment of FIGS. 3–5, the three tubes 48, 50 and 52 constitute a three tube cooling system of a size 1½ inch flow with the center or middle tube 50 being divided by the vertical divider or partition 60 into two equal vertical sections or compartments 60a and 60b which results in a 1.8 square area flow or almost exactly to the one and a half inch pump flow of the commercial pump size one and a half inch.

It can be appreciated that the construction of the cooling system is very simple and takes advantage of the division of the header into two separate chambers by virtue of the partition 56. The partition is utilized so that the longitudinal divider or separator plate 60 in the center cooling tube of the three tube cooling system sealingly connects therewith and effectively and sealingly divides the flow of the water in the central or middle tube 50. A one and a half inch tube, therefore, carries the cooling water from the header to the return fitting and a one and a half inch tube flow returns to the main header from the return fitting.

The next larger commercial pump size is a two inch which requires a two inch pipe to carry its volume of circulating water which is 3.14 square inches and is equal to a five tube cooling system 66, as shown in FIGS. 7 through 10. The five tube cooling system would be 2½ inch tubes with a volume of 3.07 square inches or exactly equal to a 2 inch volume flow which would be the volume flow capacity of the two inch commercial pump.

In the instance of the five tube cooling system 66, the center or middle tube 68 is divided by the longitudinally extending, vertically disposed partition or divider plate 70 into two equal side by side and sealed off sections or compartments 72 and 74. The compartment 72 cooperates with the first outer pair of tubes 76 and 78 for the flow of the liquid from the header 80 to the return fitting 82 in the direction of the arrows while the compartment 74 cooperates with the second outer pair of tubes 84 and 86 for the return flow of the liquid from the return fitting to the header in the direction of the arrows, as shown clearly in FIG. 7.

As in the instance of the other embodiments, one end of the longitudinal divider or partition plate 70 for the center tube is received within a suitable notch or otherwise sealingly engaged with the outer edge of the conventional partition 88 in the header and its associated stem or standpipe 90. The opposite end of the divider or partition plate 70 for the central or middle tube 68 is connected to the return fitting in the manner shown in FIG. 1 so that the center or middle tube 68 is effectively and dependably sealed into two equal side by side sections or compartments 72 and 74.

As in the instance of the stems or standpipes for the other embodiments, the stem 90 is provided with an opening 92 for connection with the engine water jacket or with the water circulating pump for the engine or other accessory in the boat and a suitable adjusting valve means 94 is provided for controlling the flow of the water or other coolant.

While the divider or partition for the single tube 20 of FIG. 1 or the center tube 50 of FIG. 3 or the center tube 68 of FIG. 7 is shown as being vertically disposed so as to divide such tubes into equal side by side vertical compartments, this vertical orientation takes advantage of the vertical placement of the partition in the header whereby the chambers in the header sealingly communicate in an easy way with the compartments in the tubes. But, the divider or partition in the tubes could be oriented in a horizontal or other plane from the vertical by utilizing another way of attaching the partition in the tubes to the partition in the header whereby such communication between the header chambers and the tube compartments can be effected.

Preferably, the fluted cooling tubes of the various embodiments are fabricated from 70/30% Cupro Nickel Alloy which is 70% copper and 30% nickel. This material provides one of the best available heat exchangers. The divider in the single tube or the center tube of the three, five or other uneven number of cooling tubes is fabricated in a flat thin elongate sheet form from a suitable plastic material of low heat conductivity, such as thermoplastic polymers manufactured by the polymerization of formaldehyde.

What is claimed is:

1. For use with a vessel having a hull and equipped internally with an engine or similar accessory having a water circulating pump; a keel cooler comprising a header unit attached to the underside of the hull and communicated through the bottom of the hull with the pump, said header unit being vertically divided by a partition into two chambers providing outflow and inflow of water relative to the pump, a return fitting attached to the underside of the hull and spaced longitudinally from the header unit and at least one cooling tube connected between the header unit and the return fitting, said tube having a longitudinal flat divider plate extending centrally thereof for the entire length of the tube and dividing it into two equal and separate flow compartments for the flow of water of the same volume from the header unit to the return fitting and then back from the return fitting to the header, said tube being longitudinally fluted and being provided with a series of diametrically opposing internal grooves extending the full length thereof and separated and defined by internal radial projections extending the full length of the tube and said longitudinal divider plate having opposing side edges sealingly fitted in a pair of diametrically opposing grooves.

2. The invention of claim 1 wherein said pair of grooves are vertically opposed and said divider plate is vertically arranged in the tube and has upper and lower side edges sealingly fitted in the said grooves.

3. The invention of claim 2 wherein said divider plate has one end sealingly engaged with the partition in the header unit.

* * * * *